United States Patent [19]

Ingenhoven

[11] Patent Number: 4,708,378

[45] **Date of Patent: * Nov. 24, 1987**

[54] ELECTRICALLY CONTROLLED CENTRAL LOCKING DEVICE FOR AUTOMOBILE DOORS

[75] Inventor: Jürgen Ingenhoven, Velbert, Fed. Rep. of Germany

[73] Assignee: Kiekert GmbH & Co. Kommanditgesellschaft, Heiligenhaus, Fed. Rep. of Germany

[ * ] Notice: The portion of the term of this patent subsequent to Jun. 2, 2004 has been disclaimed.

[21] Appl. No.: 783,486

[22] Filed: Oct. 3, 1985

[30] Foreign Application Priority Data

Nov. 28, 1984 [DE] Fed. Rep. of Germany ..... 3443288

[51] Int. Cl.[4] ..... E05C 3/26

[52] U.S. Cl. ..... 292/201; 70/257; 70/264; 74/470; 74/625; 292/336.3; 292/DIG. 3; 292/DIG. 23

[58] Field of Search ..... 292/201, 144, DIG. 3, 292/DIG. 14, DIG. 23, DIG. 25, 336.3; 74/89.15, 470, 584, 625, 424.8 R; 403/22, 21, 118; 70/262–264, 280, 237, 283, 256–257; 192/150, 56 R, 94; 464/30; 318/10, 15

[56] References Cited

U.S. PATENT DOCUMENTS

| | | | |
|---|---|---|---|
| 2,516,642 | 7/1950 | Murphy | 74/584 |
| 2,704,947 | 3/1955 | Hopkins | 74/625 |
| 2,979,965 | 4/1961 | Diebold | 74/424.8 R |
| 3,710,632 | 1/1973 | Tucker | 74/89.15 |
| 4,050,319 | 9/1977 | Stanley | 74/89.15 |
| 4,135,377 | 1/1979 | Kleefeldt et al. | 70/465 |
| 4,250,762 | 2/1981 | Weatherby | 74/424.8 R X |
| 4,342,209 | 8/1982 | Kleefeldt | 70/237 X |
| 4,364,249 | 12/1982 | Kleefeldt | 292/144 X |

FOREIGN PATENT DOCUMENTS

| | | | |
|---|---|---|---|
| 2013773 | 8/1979 | United Kingdom | 70/264 |
| 2076501 | 12/1981 | United Kingdom | 74/89.15 |
| 2144796 | 3/1985 | United Kingdom | 292/336.3 |

*Primary Examiner*—Robert L. Wolfe
*Assistant Examiner*—Lloyd A. Gall
*Attorney, Agent, or Firm*—Karl F. Ross; Herbert Dubno

[57] ABSTRACT

The disclosure is concerned with an electrically operable central locking and unlocking device for vehicle doors with mechanical locks at each door or lid, and with electromechanical actuation for such door locks in which the actuation is transferred by a vertically movable actuating rod capable of moving between an unlocked position and a locked position, to a control rod of the associated door lock. The device includes a reversible electric motor, a transmission, and an actuating mechanism for the actuating rod. The device also includes exterior ridges on a spindle-nut and projecting formations which serve to carry along the actuating rod during the lock stroke and during the unlocking stroke. The ridges can override, after completion of the lock stroke, as well as after completion of the unlock stroke, the projecting formations. The device includes a spindle which is positioned parallel to the up-and-down movement of the actuating rod, and which is provided with a self-retarding thread and on which is guided the spindle-nut which on each side is formed with the projecting ridges. The actuating rod is formed of two fork-like arms which extend on both sides of the spindle, and each arm is formed with a resiliently deflectable projecting formation.

13 Claims, 5 Drawing Figures

ELECTRICALLY CONTROLLED CENTRAL LOCKING DEVICE FOR AUTOMOBILE DOORS

CROSS REFERENCE TO RELATED APPLICATION

This application is related to commonly owned concurrently filed copending application Ser. No. 783,484 corresponding to German patent document No. 34 43 287.

FIELD OF THE INVENTION

My present invention relates to devices for locking and unlocking of doors, trunks, hoods or other lids of vehicles, such as passenger cars, trucks and the like and, more particularly, to a device for this purpose which is electrically actuated from, for example, a master panel.

BACKGROUND OF THE INVENTION

The centrally actuated devices of this type, i.e. devices which can be controlled from a central or master panel, generally cooperate with the mechanical lock mechanism at each door. The device typically includes an electromechanical drive means for each such door lock mechanism. On actuation, the drive means imparts the desired actuating motion or motions, e.g. locking or unlocking. This is achieved by way of a vertically movable actuating rod which is capable of moving between an unlocked position and a locked position of the mechanical lock, and which is connected to a control rod associated with the door lock mechanism.

The drive or actuator means can comprise an electromechanical system and can include a reversible electric motor and a transmission which imparts the desired function to the actuating rod.

The device can also include an operating means with an actuator, as well as coupling noses in the form of ridges, and coupling counter-noses in the form of projecting formations. These are arranged to be capable of, on the one hand, moving the actuating rod for the lock stroke and for the unlock stroke. They are also capable to override one another, upon completion of the lock stroke, as well as upon completion of the unlock stroke.

The coupling noses and/or the coupling counter-noses are correspondingly elastically formed or journaled so that the mentioned overriding can occur.

In a known locking device of this type, as described in German Pat. No. 29 11 630, the transmission cooperates with the actuator or piston by way of an output gear, and the actuator includes a corresponding rack formation. The actuator or piston moves parallel with respect to the separate actuating rod or bar. The arrangement of the several components is such that the coupling noses, or similar projections or formations, of the actuator engage the actuating rod. Accordingly, the actuator is formed with a resiliently mounted and swingably movable coupling nose, or similar formation. In this arrangement, the coupling nose of the actuating rod can be engaged and taken along by the formations of the actuator, as well as being capable of being overridden by it.

This system has found acceptance even though this arrangement is somewhat cumbersome to manufacture and assemble.

OBJECTS OF THE INVENTION

It is accordingly the principal object of my invention to improve the central locking device of the type briefly discussed above in such a way that the device can be more economically produced and assembled than heretofore feasible, but without affecting its proper functioning.

It is further an object of my present invention to enhance the operation of the device in such a way that its functioning is more easily carried out.

It is also an object of the invention to provide a central locking device with a reduced number of components.

It is yet another object of the invention to provide a central locking device which has satisfactory stability, reliability and functional simplicity.

SUMMARY OF THE INVENTION

These objects are attained in accordance with the invention in that the transmission acts upon a threaded spindle which is positioned parallel to the vertically reciprocating actuating rod. The spindle is provided with an external screw-type thread of the type allowing self-locking or precluding unintentional, irreversible functioning. A spindle-nut or similar element is mounted on the spindle and can move along on the spindle, i.e. up or down in conformity with the turning of the spindle. The spindle-nut has coupling noses in the form of projections or ridges.

The device also includes an actuator or actuator means having two arms, arranged in bifurcate manner and also performing the function of the actuating rod or shaft. Respectively one arm extends on a respective side of the spindle. Each arm is formed with a coupling counter-nose in the form of a projection formation.

The invention is based on the observation that in the transmission of the central locking device of the type described herein, one of the gear wheels can be replaced by a spindle, or an additional spindle can be provided. This provides the opportunity that a special element which is formed as a piston need not be used because the actuating rod per se can provide the function of the piston when it is divided or resolved as it were, into two arms, thus presenting a fork-like or bifurcate appearance as described.

This affords a considerable simplification as far as production is concerned and particularly assembly is highly simplified, whereas the kinematics of the cooperating elements, and functioning, particularly the assured functioning of the system, are not detrimentally affected.

In accordance with one preferred embodiment of the invention which is preferred due to its overall compactness of design and high stability of the electromechanical actuation or drive, the spindle, the spindle-nut, and the two arms of the actuating rod are disposed in one common plane.

It is also preferred that the spindle-nut and the exterior ridges thereof are formed as functionally inelastic components and are made, for example, of metal or a plastic/synthetic material.

It is further preferred that the two arms of the actuating rod; and/or the coupling counter-noses, are at least in part made of a material having elastic or resilient properties.

Furthermore, the two arms of the actuating rod should form, with regard to static considerations, a frame or a box. This serves to provide a sufficient stability and rigidity for all requirements.

BRIEF DESCRIPTION OF THE DRAWING

The above and other objects, features and advantages of my present invention will become more readily apparent from the following description, reference being made to the accompanying highly diagrammatic drawing in which.

SPECIFIC DESCRIPTION

Figure 5:
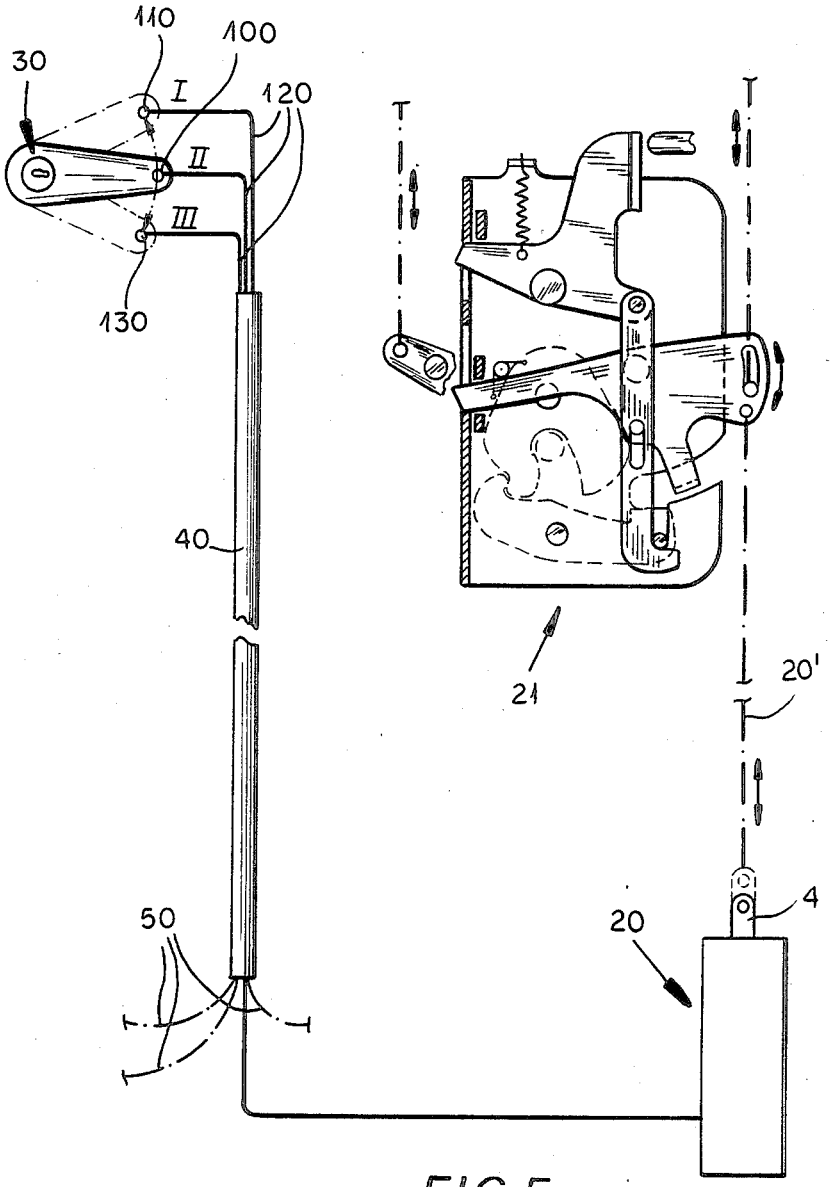
FIG. 5 is a diagram showing the mechanism of FIGS. 1–4 applied to a vehicle lock system.

The drawing shows an embodiment of the electromechanical drive or actuator assembly intended for use with the mechanical door lock in an electrical central locking device for vehicle doors and the like. The electromechanical drive acts on a control rod of the associated door lock as best seen in FIG. 5.

The device is particularly applicable in a centrally operable actuating system wherein the actuator 20 is linked to a mechanical door lock 21. The system is operated by a switch 30 which is connected to an unlock control 110, a lock control 100, and an antitheft control 130. The system may branch to other doors by means of branch lines 50. The electrical wiring is generally identified by reference numberal 40. (additional details see German Patent DE-PS No. 29 11 630).

Figure 2:
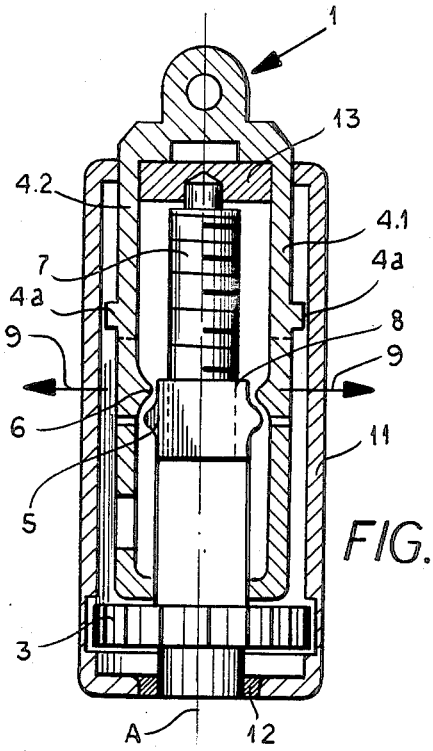
FIG. 2 is a cross section along line II—II in FIG. 1.
Figure 3:
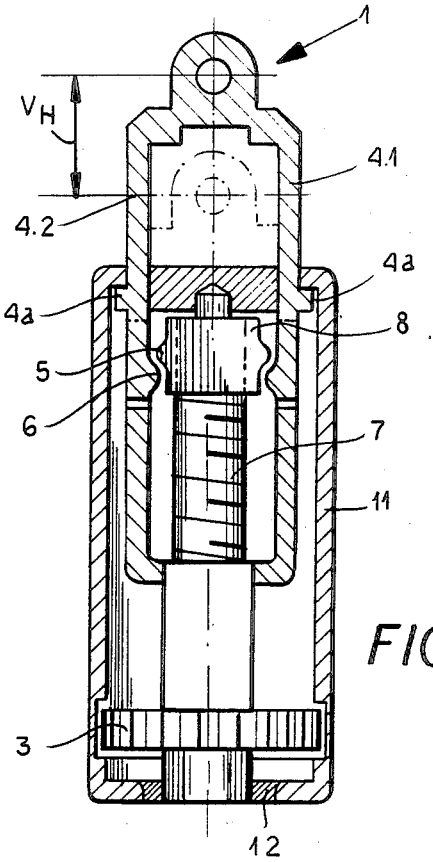
FIG. 3 is a cross section similar to FIG. 2, but showing a further operating condition.

The device includes a drive or actuating rod 1 coupled to the control rod of the lock (FIG. 5) which can move in vertically reciprocating manner, at least between an unlocked position (rod retracted-FIG. 2) and a locked position (rod extended-FIG. 3).

The device generally includes a reversible electric motor 2, a transmission 3, and means for controlling movement of the actuating rod 1. Thus, the device is equipped with an actuator member generally identified by reference numeral 4, as well as coupling noses in the form of ridges or projections 5. It also includes coupling counter-noses in the form of projecting formations 6.

The ridges 5 and the projecting formations 6 interact in such a way that the actuating rod 1 is taken along or moved during the lock stroke $V_H$, as well as during the unlock stroke or movement.

In addition, at completion of the lock stroke $V_H$ as well as after the unlock stroke, a respective projecting formation 6 can override the associated ridge 5 which is resiliently yielding.

Figure 1:
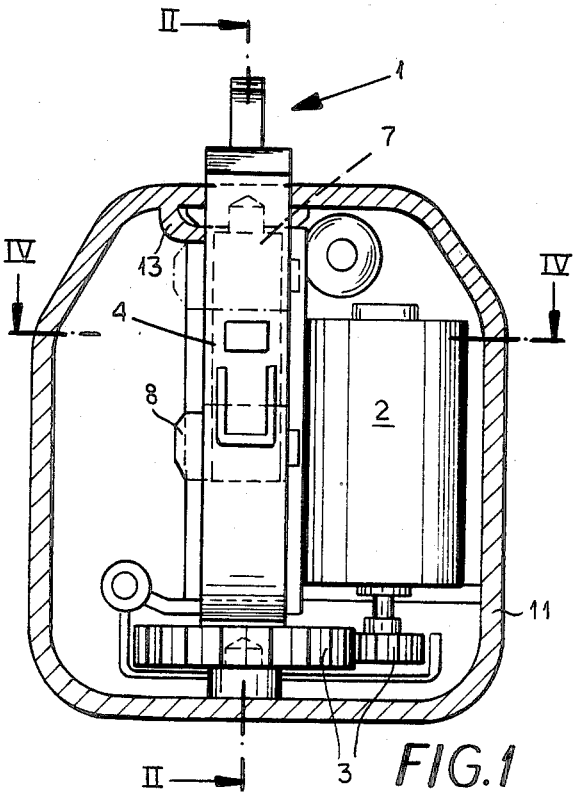
FIG. 1 is a side elevation of an electromechanical drive for the central locking device shown in part in cross section.

As is particularly evident from FIG. 1, the transmission 3 is connected with its output side or gear to a centrally disposed spindle 7. Furthermore, the spindle 7 is positioned parallel or in line with the axis A (FIG. 2) of the actuating rod 1. The actuating rod 1 is mounted in the housing 11 in such a way that it is capable of carrying out an up-and-down movement, i.e. the actuating rod 1 is capable of carrying out reciprocating motions or movements in vertical directions (compare FIGS. 1, 2 and 3). The spindle 7 is a rod formed at its upper end with an external helical screwthread of the type allowing self-locking or precluding unintentional functioning.

A spindle-nut 8, or similar element, is cooperatingly mounted on the spindle 7, i.e. on the threaded portion thereof, and this spindle-nut 8 can be moved along on and by the spindle 7, i.e. up or down in conformity with the rotation or turning of the spindle 7. The spindle-nut 8 is mounted in such a way that it does move up or down, as indicated in FIGS. 2 and 3, at least through a distance equal to $V_H$, but rotation thereof is precluded. The spindle-nut 8 can be of rectangular configuration when viewed in plan, see FIG. 4, and it is fashioned on each of the two shorter sides with exterior ridges such as projecting ridge or the like formations 5, see FIGS. 2 and 3.

The actuator 4 is a bifurcate element with parallel arms 4.1 and 4.2 which are joined to generally perform the function of the actuating rod 1. The arms 4.1 and 4.2 embrace between them the centrally disposed spindle 7, and each arm has an inwardly projecting nose or similar projecting formation 6 which respectively cooperates with the adjacent associated ridge 5 at the spindle-nut 8.

Figure 4:
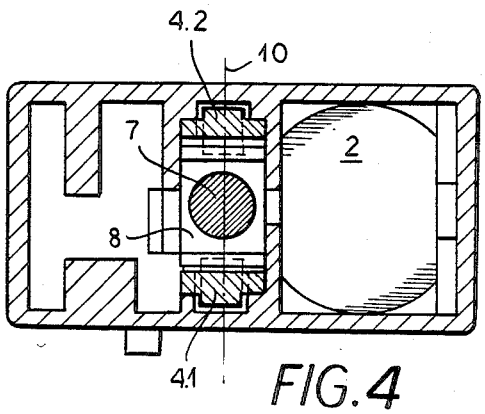
FIG. 4 is a cross section along line IV—IV in FIG. 1.

As can best be seen in FIG. 4, the spindle 7, the spindle-nut 8, and the arms 4.1 and 4.2 are disposed in a common plane 10.

The spindle-nut 8 and its exterior ridges 5 are formed as functionally inelastic components, i.e. these components are made of a corresponding material with generally high rigidity. Plastic/synthetic resin materials having the respective strength and stability can be used. In contrast the two arms 4.1 and 4.2 of the drive shaft 1 are at least in part made of a material having properties which allow elastic or resilient movement or displacement, particularly of the projecting formations 6 of arms 4.1 and 4.2.

Accordingly, at completion of the upward stroke, i.e. the lock stroke $V_H$, the ridges 5 override the projecting formations 6, whereby the ridges 5 deflect the formations 6 in the outward directions indicated by the arrows 9 (FIG. 2).

The upwardly directed movement of the actuating rod 1, i.e. of the arms 4.1 and 4.2 is limited by the external projections **4*a* on the arms 4.1 and 4.2 which will contact the top of the housing 11** when the fully locking position has been reached.

When comparing the respective positions of the movable components in FIG. 2, showing the unlocked condition of the locking device, and in FIG. 3, showing the locked condition of the device, it will be clear that the actuating rod 1 can be moved from the retracted position, corresponding to the unlocking or releasing condition of the device, into the extended position corresponding to the locking position of the device. Of course movement of the actuating rod 1 can be reversed whereby it retracts from the extended position into the withdrawn position, thereby allowing unlocking of the device.

The actuating rod 1 is moved in conformity with the locking stroke or distance $V_H$ as well as the unlocking stroke (reverse movement), with the formations 5 overriding the projections 6 at the arms 4.1 and 4.2 at the respective end points of each stroke or lift.

The embodiment shows that the actuating rod 1, i.e. the arms 4.1 and 4.2 thereof, form a frame or box-like structure having corresponding static properties, rigidity, and stability.

The projecting formations 6 are arranged on a generally rectangular base when viewed in the side elevation according to FIG. 1. In order to accommodate their being overridden by the ridges 5 and to allow a resilient deflecting movement or displacement, the arms 4.1 and 4.2 are cut in a U-shape fashion.

The lower end of the spindle 7 is journaled in a bushing or the like 12 at the bottom wall of the housing 11, and the upper end of the spindle 7 is correspondingly mounted by means of a holder arm 13 near the upper wall of the housing 11.

I claim:

1. A device for electrically locking and unlocking vehicle doors and the like and including at least one door having an individual lock, and having electromechanical actuating means for actuating a control rod operatively connected to said individual lock, said device comprising:

a reversible electric motor having an output;

a transmission connected to said output; and an actuating mechanism for operating said lock, said mechanism comprising:

an actuating member connected to said rod and formed with two spaced-art parallel arms which carry respective inwardly projecting formations;

a spindle received between said arms and driven by said transmission, said spindle being formed with a self blocking screwthread; and a spindle-nut threadedly mounted on said spindle and having ridges which are dimensioned and positioned to carry along said actuating member during a lock stroke thereof, by engaging said projecting formations of said actuating member, and said arms and the respective projecting formations being formed of sufficiently elastic material to resiliently allow the respective ridges, upon completion of a respective lock stroke and upon completion of a respective unlock stroke, to override said projecting formations of said arms.

2. The device defined in claim 1 wherein said spindle, said spindle-nut, and said arms are disposed in a common plane.

3. The device defined in claim 1 wherein said ridges on said spindle-nut and said spindle-nut are substantially inelastic components.

4. The device defined in claim 1 wherein said arms are disposed in a frame-like pattern.

5. The device defined in claim 1 wherein said arms are disposed in a box-like pattern.

6. The device defined in claim 1 wherein said at least two arms are disposed in bifurcate manner when viewed in cross section.

7. The device defined in claim 1 wherein said spindle-nut is equipped at each of two opposite sides with at least one such ridge.

8. The device defined in claim 1 wherein said transmission includes meshing gear wheels.

9. In an electrical central locking device for vehicles with mechanical door locks at each door or lid and with electromechanical drives for such door locks, which are driven by an up-and-down movable drive rod capable of moving between an unlocked position and a locked position, and act on a control rod of the associated door lock, whereby each electromechanical drive includes:

a reversible electric motor;

a transmission connected to said motor; and an actuating device for the drive rod, which actuating device is equipped with an actuator as well as coupling noses and coupling counter-noses which carry along the drive rod during the lock stroke and during the unlocking stroke, and which after each lock stroke and after each unlock stroke can be driven over one another, the improvement wherein:

the transmission includes a spindle positioned parallel to the up-and-down movement of the drive rod provided with a self-blocking thread on which is guided a spindle-nut which on each of two opposite sides is provided with projecting formations, and the actuator is formed of two fork arms straddling the spindle provided with counter-formations formed from resiliently deflectable material, cooperating with the formations on said nut, said formations and counter-formations constituting said noses and counter-noses.

10. The improvement defined in claim 9 wherein the spindle, the spindle-nut and the fork arms are disposed in a common plane.

11. The improvement defined in claim 10 wherein the spindle-nut and the spindle-nut coupling noses are substantially inelastic.

12. The improvement defined in claim 11 wherein the fork arms are resiliently deflectable outwardly.

13. The improvement defined in claim 11 wherein the fork arms form a frame.

* * * * *